United States Patent [19]

De Angelo et al.

[11] Patent Number: 5,010,754

[45] Date of Patent: Apr. 30, 1991

[54] LOCK ACTUATOR WITH REMOVABLE OPERATOR

[75] Inventors: Nelson J. De Angelo, Southington; Kenneth T. Theriault, Meriden, both of Conn.

[73] Assignee: Lori Corporation, Southington, Conn.

[21] Appl. No.: 549,280

[22] Filed: Jul. 6, 1990

[51] Int. Cl.[5] ..... E05B 11/00

[52] U.S. Cl. ..... 70/389; 70/395

[58] Field of Search ..... 70/395, 389, 400, 390

[56] References Cited

U.S. PATENT DOCUMENTS 4,120,184 10/1978 Gerlach ..... 70/389

*Primary Examiner*—Robert L. Wolfe

*Attorney, Agent, or Firm*—Chilton, Alix & Van Kirk

[57] ABSTRACT

An actuator for a lock is provided with a operating handle which may be easily removed through the use of a special key and may also be reinstalled without the use of the special key or tools. The actuator may be "rekeyed" as necessary to maintain security and removal of the handle will lock the actuator.

20 Claims, 3 Drawing Sheets

LOCK ACTUATOR WITH REMOVABLE OPERATOR

BACKGROUND OF THE INVENTION

1. Field of the Invention

The present invention relates generally to enhancing building security and particularly to facilitating the removal of operating knobs from manually operated door lock inside actuators to thereby prevent the use of such an actuator to unlock an access door to a secured area. More specifically, this invention is directed to locking devices for doors, such locking devices having a manually operable inside actuator, and especially to door locks where the control knob or lever of the inside actuator may be easily removed and reinstalled. Accordingly, the general objects of this invention are to provide novel and improved methods and apparatus of such character.

2. Description of the Prior Art

While not limited thereto in its utility, the present invention is particularly well suited for incorporation into locks which are intended to be installed on building entry doors having one or more glass panels therein. Such locks are commonly installed in proximity to a thumb operated latch mechanism and may take the form of a dead bolt lock. These entry-way locks are characterized by inside and outside actuators which, via an adaptor or tailpiece, operate a bolt. The outside actuator will be key operated while the inside actuator will be a manually operable control member such as a turnknob.

In order to ensure the ability to rapidly evacuate the premises secured by the lock in the case of an emergency, the inside actuator will not be key operated. Thus, the bolt may be withdrawn and the door opened from the inside merely by grasping and rotating the turnknob of the inside actuator. This arrangement, however, presents one desiring to gain unauthorized entry with the possibility of breaking a glass panel in the door in order to reach and subsequently operate the turnknob of the inside actuator.

There has been a long-standing desire to provide some mechanism for disabling the inside actuator of a lock when the premises secured by that lock are to be left vacant. This desire, for economic and/or aesthetic reasons, is not fulfilled by employment of a supplemental locking device on the door. This desire, if to be successfully addressed, must achieve the function of disabling the inside actuator through a procedure which is highly reliable and extremely easy to implement.

SUMMARY OF THE INVENTION

The present invention overcomes the disadvantages of the prior art and, in so doing, provides an uncomplicated and reliable method for removal and reinstallation of the control member from a lock actuator. Apparatus in accordance with the present invention utilizes, as the inside actuator, a cylinder-type lock mechanism. The operator for this inside actuator, a turnknob for example, is provided with a properly bitted key blade extension which, when inserted in the keyway defined by the plug of the cylinder lock, is "trapped". This trapping is accomplished by providing the key blade extension of the operator with at least a first cut which is engaged by a pin tumbler in such a manner as to prevent withdrawal of the blade extension from the lock. The trapped operator may thereafter be employed, i.e., the turnknob may be rotated, in the conventional manner to operate the bolt via an adaptor coupled to the rotatable plug of the cylinder lock.

The operator is provided with a slot which extends along the key blade extension thereof to the trapping cut. A special key having a camming surface on the end thereof is provided. Insertion of this special key into the slot will result in the camming of the pin tumbler which has trapped the blade extension out of the trapping slot, thus permitting withdrawal of the turnknob subassembly from the actuator.

A particularly novel feature of the present invention resides in the ability to "rekey" the actuator without affecting the trapping function. Thus, while the pin tumblers of the cylinder lock which cooperate with the bitting on the blade extension of the operator may be changed, the pin tumbler which engages the blade extension to trap the operator is permanently captured in the cylinder lock.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
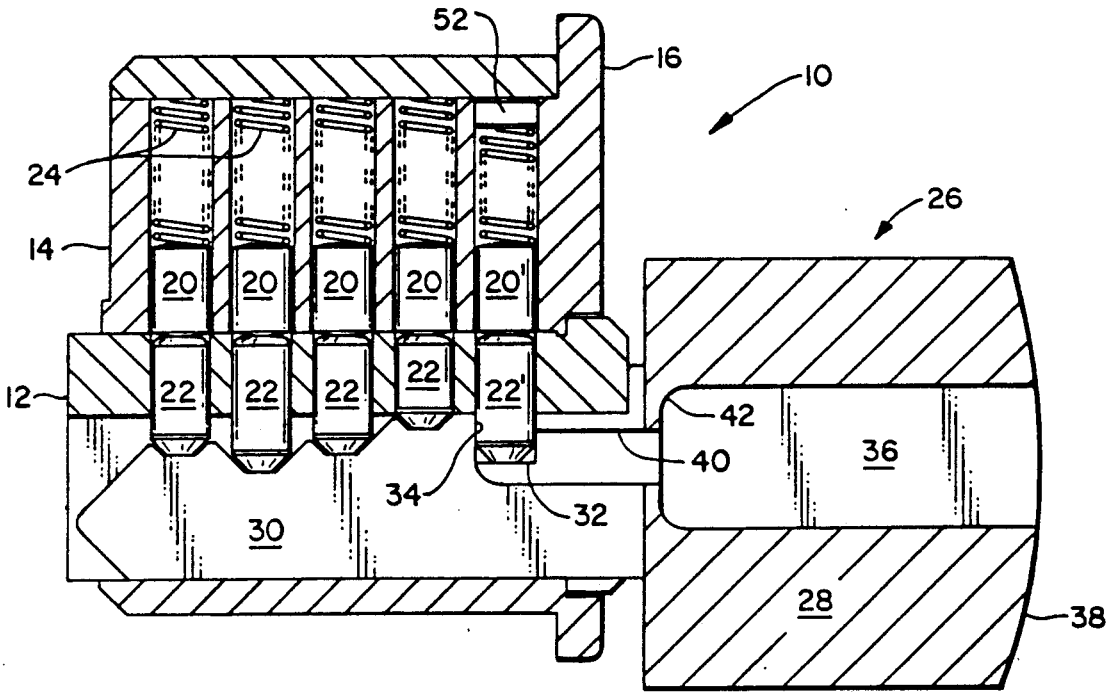
FIG. 1 is a cross-sectional side elevation view of an inside actuator for a lock in accordance with the present invention, FIG. 1 depicting the actuator in the normal operating condition.

While not limited thereto in its utility, the present invention may be employed as the inside actuator of a lock such as depicted in U.S. Pat. No. 4,272,974, i.e., the present invention may be substituted for the mortise cylinder 15 of the patented lock. Regardless of the use environment, an actuator in accordance with the present invention will be in the form of a cylinder lock, indicated generally at 10, having a plug 12 and a shell 14. The shell 14 defines a tubular bore which receives the plug 12, the plug being rotatable relative to the shell. An adaptor, not shown, will be coupled to the plug for rotation therewith, the adaptor mechanically linking the plug to the bolt whereby rotation of the plug relative to the shell will result in withdrawal of the bolt from the door frame mounted receiver, thereby permitting opening of the door. A plurality of adaptors for a cylinder-type lock are depicted in FIG. 1 of U.S. Pat. No. 4,672,828. The cylinder lock 10 is also provided with a front plate 16 which is affixed to shell 14 in any suitable manner.

Figure 4:
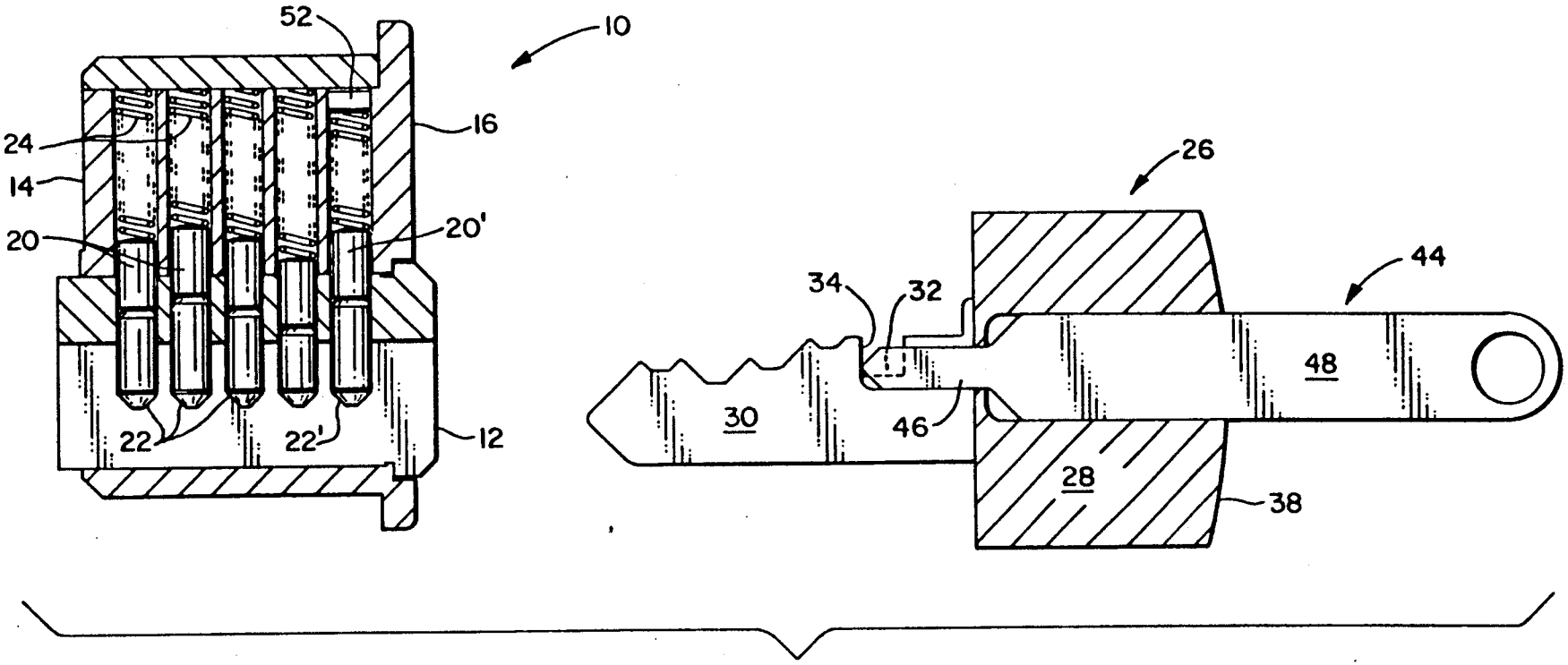
FIG. 4 is an exploded view, similar to FIGS. 1 and 3 but on a reduced scale, showing the inside actuator with the turnknob removed.

In the disclosed embodiment, which is meant to be exemplary only of an inside actuator in accordance with the invention, the shell 14 is provided with a linear array of five bores which have their axes oriented transversely with respect to the axis of rotation of plug 12. Plug 12 is provided with bores which, with the plug in the unrotated condition, align with the bores in the shell. The unrotated state of the plug corresponds to the locked or bolt fully extended condition of the associated door lock. The aligned bores in the shell and plug receive pin tumbler stacks which each comprise a top or driver pin 20 and a bottom pin 22. The pin tumbler stacks are biased by springs 24 toward the axis of rotation of plug 12. Plug 12 defines a keyway which intersects the tumbler pin receiving bores and, in the customary manner as depicted in FIG. 4, when a properly bitted key blade is not present in the keyway, the driver pins of the tumbler pin stacks will all extend across the shear line defined by the interface of the plug and shell to thereby prevent the relative rotation between the plug and shell. As depicted in FIG. 1, insertion of a properly bitted key blade in the keyway of plug 12 will reposition the pin tumbler stacks such that the shear line between the driver pin 20 and bottom pin 22 of each stack is located on the shear line between the plug and shell and, accordingly, relative rotation between the plug and shell is permitted.

The lock/actuator described above is of conventional design. The present invention departs from the prior art in that the key blade, which contains the bitting for positioning of the pin tumbler stacks, is integral with an operator such as the turnknob which is indicated generally at 26. Turnknob 26 comprises a handle or control member portion 28 and a blade extension 30. The blade extension 30 has a cross-sectional shape which is complementary to that of the keyway in plug 12 and, in the disclosed embodiment, is provided with bitting on one edge in the form of a sawtooth cut. However, in addition to the sawtooth cut bitting, blade extension 30 is provided with a key trapping or retaining notch 32 which, with the blade extension 30 fully inserted into the keyway, will be in registration with the pin tumbler stack which is located closest to front plate 16, the driver and bottom pins of this forwardly disposed pin tumbler stack being respectively indicated at 20' and 22'. Retaining notch 32 is provided, at least on its side edge which is located closest to the free end of blade extension 30, with a shoulder 34 which extends generally transversely with respect to the axis of plug rotation. This shoulder, as may be seen from FIG. 1, will engage the side of bottom plug 22' when the turnknob 26 is installed and will thereby prevent withdrawal of blade extension 30 from the keyway. Thus, with the actuator of the present invention in the condition shown in FIG. 1, the turnknob 26 cannot be separated from the cylinder lock 10 but can be rotated to cause retraction, via an appropriate adaptor coupled to the rotatable plug 12, of the bolt of the lock of which the actuator of the present invention forms a part.

The turnknob 26 is provided with a slot 36 which extends inwardly from the face 38 of the handle portion 28 thereof. Slot 36 extends into the blade extension 30 so as to intersect the retaining notch 32. In the disclosed embodiment, the inwardly disposed portion 40 of slot 36, i.e., the portion of the slot extending outwardly into handle portion 28 from the bottom or blind end thereof, the blind end being located in the blade extension, is of reduced size relative to the remainder of slot 36. The transition between portion 40 of slot 36 and the remaining larger size portion thereof defines a stop shoulder 42.

Figure 2:
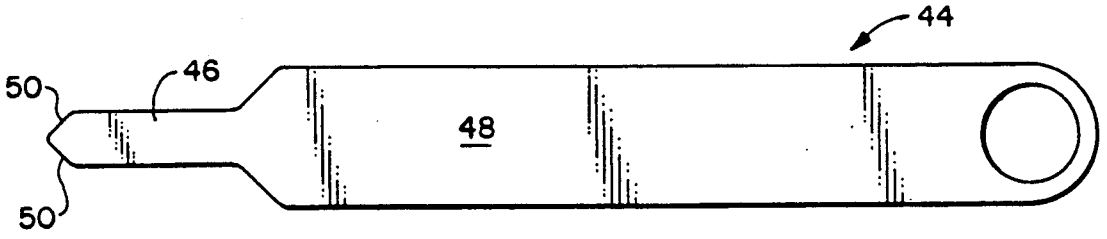
FIG. 2 is a side elevation view of special key for use with the actuator of FIG. 1.
Figure 3:
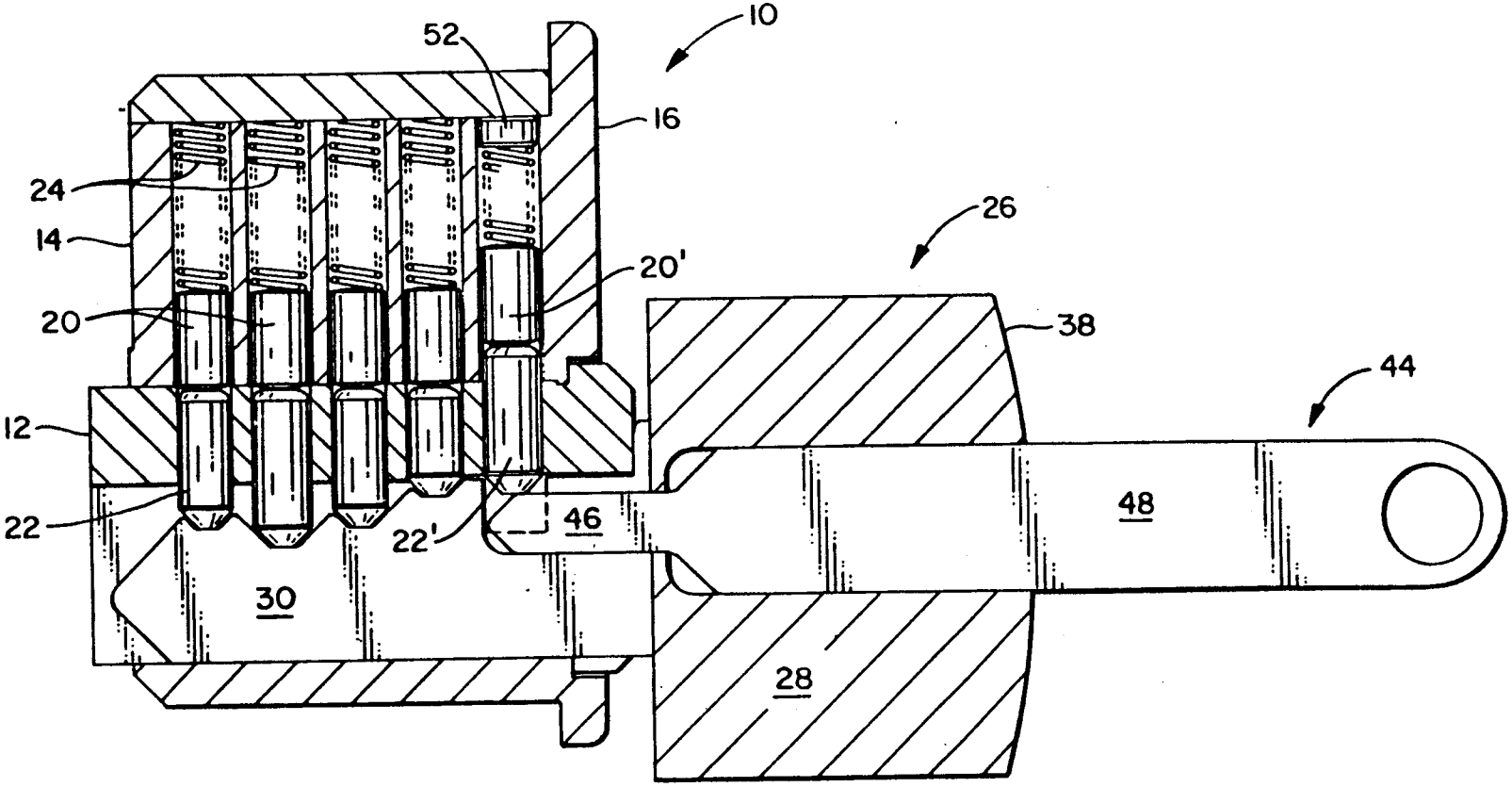
FIG. 3 is a view similar to FIG. 1 depicting the actuator with the special key of FIG. 2 inserted in the turnknob.

An actuator in accordance with the present invention is provided with a special key which has been indicated generally at 44 in FIGS. 2–4. Key 44 has a shape which is complementary to the stepped slot 36, i.e., the key 44 is provided with a narrow leading portion 46, which is received in portion 40 of slot 36, and a wider portion 48 which extends to the opposite end of the key. Portion 48 of key 44 is complementary, in cross-sectional area, to the larger size outwardly disposed portion of slot 36 and is longer than the depth of the larger size portion of slot 36, as may be seen from FIGS. 3 and 4. In the disclosed embodiment, key 44 is reversible. Key 44 is provided, at the free end of portion 46 thereof, with a pair of oppositely disposed cam surfaces 50.

Referring to FIG. 3, if it is desired to remove the turnknob 26, the key 44 is inserted in slot 36. Insertion of the key into the slot will result in a cam surface 50 at the end of the key contacting bottom pin 22' and raising the pin tumbler stack such that bottom pin 22' is no longer trapped in retaining notch 32.

As shown in FIG. 4, after the key 44 has been inserted in the slot 36 of turnknob 26, the turnknob can be withdrawn. Withdrawal of the turnknob results in the pin tumbler stacks being repositioned under the influence of the biasing springs 24 and places the actuator in a locked or disabled condition. The actuator can be "unlocked" only by reinsertion of the turnknob 26. The "locking" of the inside actuator may serve the supplemental function of preventing unbolting of the door through defeating the key-operated outside actuator.

In the disclosed embodiment, the pin tumbler stack which cooperates with the retaining notch 32 in turnknob blade extension 30 are permanently captured in the shell and plug by a press-fitted cap member 52. This permits the actuator to be "rekeyed" without loss of the permanently installed pin tumbler stack which accomplishes the trapping of the removable actuator.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An actuator for a movable latch member comprising:

lock means, said lock means including a shell and a generally cylindrical plug which is rotatable about an axis relative to said shell, said plug and shell defining a shear line at the interface therebetween and also cooperating to define a plurality of pin tumbler receiving bores which extend across said shear line with said plug in the unrotated state, a pin tumbler comprising at least a resiliently biased driver pin and a bottom pin being disposed in each of said bores, said plug also defining a keyway which intersects said bores whereby the bottom pins of said tumblers may partly extend into said keyway, at least some of said pin tumblers thereby defining the bitting for said lock means, said bitting defining pin tumblers being replaceable whereby the lock means bitting may be changed, at least one of said pin tumblers being a trapping pin tumbler, said one pin tumbler being permanently captured in said lock means;

an operator for said lock means, said operator comprising manually operable handle means and a blade extension, said blade extension projecting from said handle means and having a size and shape generally complementary to said plug defined keyway whereby said blade extension may be received in said keyway, said blade extension being provided with bitting defining surface irregularities which cooperate with the pin tumblers which define the lock bitting to position such pin tumblers such that the shear line between pins thereof lies on the shear line between said plug and shell, said blade extension further being provided with a trapping recess configured to receive the bottom pin of said trapping pin tumbler, a shear line between pins of said trapping pin tumbler being located on the shear line between said lock means plug and shell when said trapping pin tumbler bottom pin is received in said trapping recess, the presence of said operator blade extension in said plug defined keyway permitting relative rotation between said lock means plug and shell by the application of torque to said handle means, the engagement of said trapping pin tumbler bottom pin in said blade extension recess preventing withdrawal of said blade extension from said keyway, said operator further having a slot which extends through said handle means and into said blade extension to intersect said trapping recess; and an operator release key, said key having a shape which is generally complementary to said slot in said operator and a length which is greater than the depth of said slot, said release key being provided with a camming surface which cooperates with the bottom pin of said trapping pin tumbler to force said trapping pin tumbler bottom pin out of said trapping recess whereby said operator blade extension may be axially withdrawn from said plug keyway be imparting an axial force to said handle means when said release key is inserted in said slot, such withdrawal of said operator blade extension separating said operator from said lock means thereby permitting said pin tumblers to be repositioned whereby pin tumbler comprising pins extend across said shear line between said plug and shell and relative rotation therebetween is prevented.

2. The apparatus of claim 1 wherein said operator blade extension trapping recess is defined by at least a first wall which extends in a generally transverse direction with respect to the axis of rotation of said cylinder lock means plug.

3. The apparatus of claim 1 wherein said slot in said operator has a generally stepped configuration with a first portion being disposed in said handle means and a second portion comprising an extension of said first portion which is partly in said handle means and partly in said blade extension, said slot second portion having a smaller cross-sectional area than said slot first portion.

4. The apparatus of claim 1 wherein said slot in said operator terminates at said trapping recess in said blade extension.

5. The apparatus of claim 1 wherein said release key camming surface is located on a first end of said release key.

6. The apparatus of claim 1 wherein said release key is provided with a pair of oppositely disposed camming surfaces whereby said release key is reversible.

7. The apparatus of claim 2 wherein said slot in said operator has a generally stepped configuration with a first portion being disposed in said handle means and a second portion comprising an extension of said first portion which is partly in said handle means and partly in said blade extension, said slot second portion having a smaller cross-sectional area than said slot first portion.

8. The apparatus of claim 2 wherein said slot in said operator terminates at said trapping recess in said blade extension.

9. The apparatus of claim 7 wherein said slot in said operator terminates at said trapping recess in said blade extension.

10. The apparatus of claim 2 wherein said release key camming surface is located on a first end of said release key.

11. The apparatus of claim 3 wherein said release key camming surface is located on a first end of said release key.

12. The apparatus of claim 4 wherein said release key camming surface is located on a first end of said release key.

13. The apparatus of claim 7 wherein said release key camming surface is located on a first end of said release key.

14. The apparatus of claim 8 wherein said release key camming surface is located on a first end of said release key.

15. The apparatus of claim 9 wherein said release key camming surface is located on a first end of said release key.

16. The apparatus of claim 3 wherein said release key is provided with a pair of oppositely disposed camming surfaces whereby said release key is reversible.

17. The apparatus of claim 5 wherein said release key is provided with a pair of oppositely disposed camming surfaces whereby said release key is reversible.

18. The apparatus of claim 13 wherein said release key is provided with a pair of oppositely disposed camming surfaces whereby said release key is reversible.

19. The apparatus of claim 14 wherein said release key is provided with a pair of oppositely disposed camming surfaces whereby said release key is reversible.

20. The apparatus of claim 15 wherein said release key is provided with a pair of oppositely disposed camming surfaces whereby said release key is reversible.

* * * * *